United States Patent [19]

Foley

[11] 4,054,120

[45] Oct. 18, 1977

[54] BLOW GUN WITH MOUTHPIECE INDENTATIONS AND PROJECTILE THEREFOR PREVENTED BY INDENTATIONS FROM MOVEMENT THEREPAST

[76] Inventor: Charles F. Foley, 3908 Merriam Road, Minnetonka, Minn. 55343

[21] Appl. No.: 685,728

[22] Filed: May 12, 1976

[51] Int. Cl.[2] ..... F41B 1/00; F41B 1/02

[52] U.S. Cl. ..... 124/62; 124/41 C; 124/83; 273/102 R; 273/106.5 A

[58] Field of Search ..... 124/41 R, 62, 83, 41 C; 273/106.5 A

[56] References Cited

U.S. PATENT DOCUMENTS

| | | | |
|---|---|---|---|
| 2,460,924 | 2/1949 | Dally | 124/62 |
| 3,137,287 | 6/1964 | De Arbun | 124/62 |
| 3,220,398 | 11/1965 | Martin et al. | 124/62 |
| 3,388,696 | 6/1968 | Hoverath et al. | 124/62 |
| 3,685,828 | 8/1972 | Getgey et al. | 124/62 X |
| 3,829,094 | 8/1974 | Goldfarb et al. | 273/106.5 A X |
| 3,908,626 | 9/1975 | Hammond | 124/41 R X |
| 3,980,303 | 9/1976 | Bolton | 273/106.5 A X |

FOREIGN PATENT DOCUMENTS

| | | | |
|---|---|---|---|
| 596,071 | 7/1959 | Italy | 124/62 |
| 600,499 | 4/1948 | United Kingdom | 124/62 |

*Primary Examiner*—Richard T. Stouffer

*Attorney, Agent, or Firm*—Dugger, Johnson & Westman

[57] ABSTRACT

A blow gun and projectile combination for use in connection with targets which provide safety, enjoyment, and fun without being hazardous. The blow guns are accurate with the projectiles used, and the projectiles are extremely lightweight and do not have sufficient mass to cause injury if fired so that they strike a person. In addition, the blow gun includes mouthpiece indentations. These indentations cooperate with a disc located on the forward end of each projectile to prevent the projectiles from being inhaled through the mouthpiece by a user of the blow gun.

3 Claims, 6 Drawing Figures

BLOW GUN WITH MOUTHPIECE INDENTATIONS AND PROJECTILE THEREFOR PREVENTED BY INDENTATIONS FROM MOVEMENT THEREPAST

BACKGROUND OF THE INVENTION

1. Field of the Invention

The present invention relates to blow guns using projectiles or slugs made of a soft foam material which will not injure bystanders, but which can be used in connection with target games.

2. Prior Art

In the prior art, the use of safe darts has been advanced. The use of Velcro materials in darts and dart boards is known, as evidence by many devices on the market.

Of course, blow guns have been known for centuries, and used for amusement as well as for weapons. However, for amusement devices, blow guns are extremely hazardous because to date the projectiles used have been capable of injury to bystanders if they happen to hit a person.

SUMMARY OF THE INVENTION

The present invention relates to a blow gun and projectile combination wherein the projectile is made primarily of a soft foam material and which has means for causing adherence of the projectile to another object at one end thereof. The soft foam can be propelled with accuracy through a tubular blow gun, but will not generate a sufficient force to cause injury. Yet, at moderate ranges in the range of ten or more feet, the accuracy is good and can provide games of skill.

The unit is relatively low cost to make, and various means for causing adherence of the projectile to a surface can be employed. Small suction cups could be used, and other adhering material, but as shown, the unit projectile and target use "Velcro" type hook and loop fasteners. The hook and loop material is supported on a relatively rigid disc-like base on one end of the projectile. Other types of adhering members also can be used, such as small suction cups.

DESCRIPTION OF THE PREFERRED EMBODIMENTS

Figure 1:
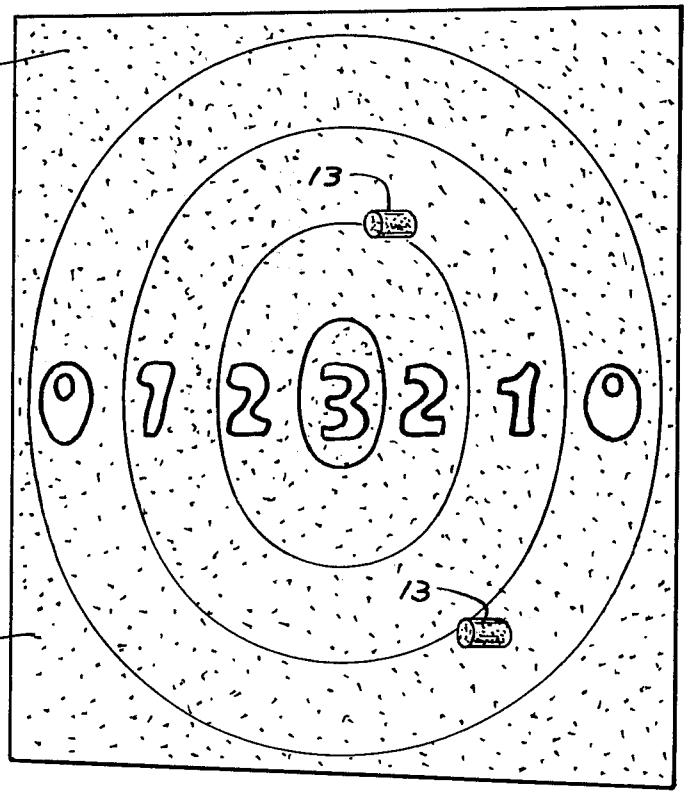
FIG. 1 is a perspective view of a blow gun in use with a target.
Figure 2:
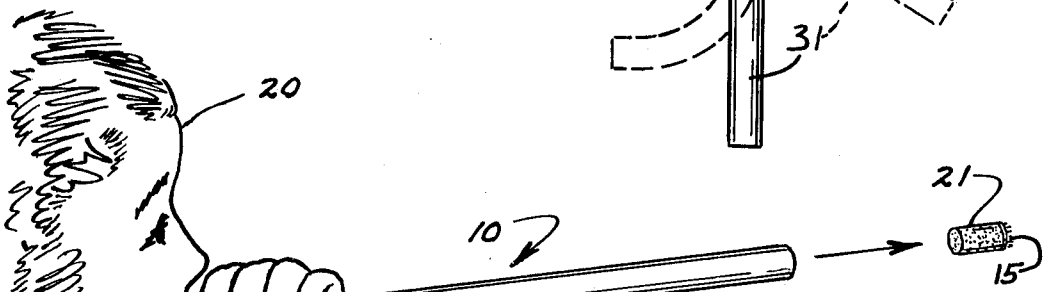
FIG. 2 is a side view of a typical blow gun used with the present invention.

Referring to FIG. 1, a blow gun illustrated generally at 10 comprises a hollow tubular plastic barrel 11, a mouthpiece 12, at one end thereof, which as shown is flared slightly for use. The interior of the barrel is of size to snugly receive a projectile illustrated generally at 13.

The projectile 13 is cylindrical (and the barrel 11 is cylindrical throughout its length) and is made of a soft, nonrigid foam material of relatively light weight. The foam cylinder engages the interior surface of the barrel with substantially no clearance, but with a sliding fit. At one end of the cylindrical projectile 13 there is a relatively stiff or rigid disc 14 which has hook and loop type material known commonly as Velcro indicated at 15 on an outer end surface thereof. The disc is of size to fit into the barrel as well.

The target member 16 is mounted in a suitable manner, and has a face 17 of fuzzy material such as terry cloth, or pile material to which the hook and loop material 15 will adhere. The target face 17 can be made up in ordinary target form, and when the hook and loop material indicated at 15 engages the face 17, the projectiles 13 will adhere to the surface where they strike it, as generally shown in the drawing of FIG. 1.

Figure 3:
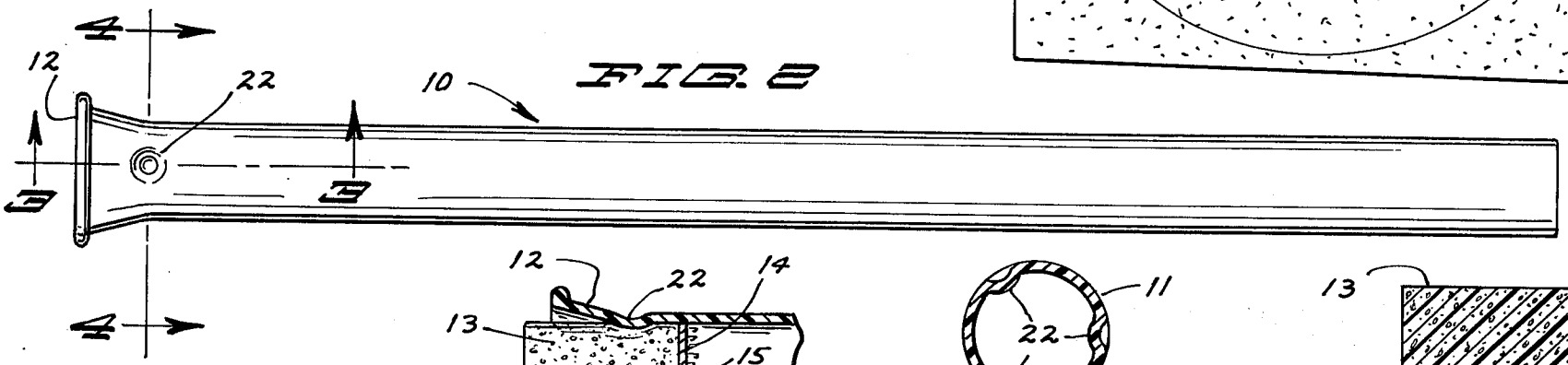
FIG. 3 is a sectional view taken as on line 3—3 in FIG. 2.
Figure 5:
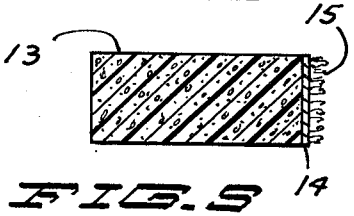
FIG. 5 is a perspective view of a typical projectile used with the present invention.
Figure 4:
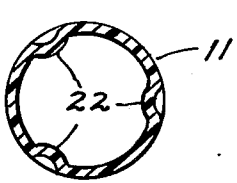
FIG. 4 is a sectional view taken as on line 4—4 in FIG. 2.
Figure 9:
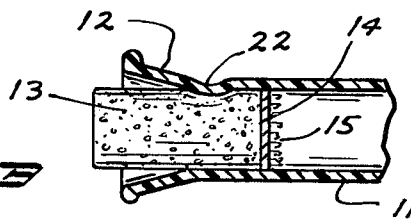

The mounthpiece 12 is used by a player, indicated generally at 20, for blowing air through the barrel. When the projectile is inside the barrel, generally as shown in FIG. 3, the soft foam forms a sufficient seal against the interior of the barrel when there is air pressure on the base end of the projectile so that air pressure built up by a person blowing on the end may impel the projectile outwardly as shown generally at 21 toward the target.

The mouthpiece end 12 of the barrel also has a plurality of indentations indicated generally at 22 arranged around the periphery thereof and these indentations are of sufficient size to prevent the disc 14 from being drawn back through the mouthpiece in the mouth of the user. This is also illustrated in FIG. 3, to show where the indentations 22 form a smaller size opening than the diameter of the disc 14 to prevent the projectile from being inhaled.

The projectiles have sufficient weight so that they will travel in a straight path when impelled out of the barrel under ordinary blowing force of a user for a relatively good distance so that skill enters into the use of the blow gun.

The foam material is lightweight, nonrigid, compressible foam. The relatively rigid discs 14 can be made of a cardboard or even elastomeric material, and are not of a great mass, but do add a little mass to the leading end of the projectile so that it will orient itself properly and give weight distribution during flight. The disc thus comprises a head member on the soft foam projectile carrying the means for causing adherence to the target.

Figure 6:
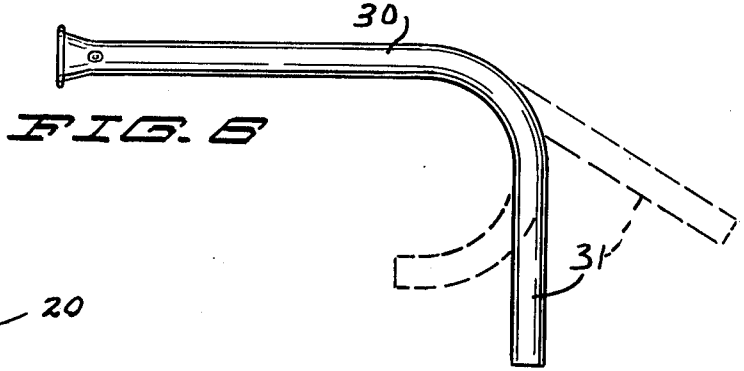
FIG. 6 is a view of a modified blow gun made of flexible or semirigid plastic to shoot around corners or at angles.

In FIG. 6 a modified blow gun or tube 30 is shown. The blow gun 30 is tubular as before but has an end portion 31 bent at right angles, or the end portion may be positioned or bent at different positions as shown in dotted lines.

The foam pellets or projectiles will move past relatively sharp bends without problems because the foam gives and bends.

The tube or blow gun 30 may be twisted to cause the pellets to act erratically if desired. The flexibility of the gun adds amusement to the usage.

The same foam pellets may be used in both blow guns or tubes.

The foam projectiles or pellets will give and yield to let the leading end disc bend at an angle for insertion past the safety notches from the mouthpiece end, but once in the blow gun the pellets cannot be sucked past the safety indentations 22. Also the body of foam projectiles acts as an aerodynamic stabilizer and only a light end weight is necessary. When the projectile strikes a surface the foam apparently absorbs energy and dampens any vibration or rebound tendency. This aids in preventing rebounding of the projectile.

The unit can be made with a separate mouthpiece if desired. The separate mouthpiece would have the indentations formed and would frictionally attach to a straight barrel. This can simplified manufacture of the blow guns.

What is claimed is:

1. In combination, a projectile, blow gun and target combination comprising a projectile formed as a generally cylindrical soft foam pellet having a length generally twice its diameter, and having a head including a flat disc-shaped member of substantially the same diameter as the pellet, a layer of hook and loop type material fixed to the outer end surface of said disc-shaped member, and a blow gun for impelling said projectile, said blow gun comprises a molded plastic cylindrical barrel having a mouthpiece end formed to fit the users mouth, at least three indentation means molded into and generally symmetrically spaced around said barrel adjacent said mouthpiece end, said indentation means forming a smaller size opening through said barrel than the diameter of said disc-shaped member to prevent said disc-shaped member from being forced rearwardly through said mouthpiece end, said indentation means also forming a sufficiently large opening through said barrel that said pellet may be forced therepast toward the end of the barrel opposite from said mouthpiece, said barrel being the size so that said soft foam pellet forms an air seal against the inner surface of said barrel, and a target member having a surface for causing adherence of said hook and loop type material to the target member.

2. The combination of claim 1, wherein said blow gun does not have a straight central axis.

3. The combination of claim 1 wherein said blow gun barrel is flexible and can be manually bent into a curve.

* * * * *

UNITED STATES PATENT AND TRADEMARK OFFICE

CERTIFICATE OF CORRECTION

PATENT NO. : 4,054,120

DATED : October 18, 1977

INVENTOR(S) : Charles F. Foley

It is certified that error appears in the above-identified patent and that said Letters Patent are hereby corrected as shown below:

Column 2, line 9, "The" should be--A--. Column 3, line 6, "simplified" should be--simplify--; Column 3, line 17, (Claim 1, line 9), "comprises" should be--comprising--.

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*